US007467719B2

(12) United States Patent
Crowell et al.

(10) Patent No.: US 7,467,719 B2
(45) Date of Patent: Dec. 23, 2008

(54) MOBILE STORAGE SYSTEM FOR WEAPONS AND WEAPON ACCESSORIES

(76) Inventors: Mike L. Crowell, 9750 N. Monterey Dr., Unit #64, Fountain Hills, AZ (US) 85268; Don R. Lindebak, 4614 S. Parkside Dr., Tempe, AZ (US) 85282

( * ) Notice: Subject to any disclaimer, the term of this patent is extended or adjusted under 35 U.S.C. 154(b) by 75 days.

(21) Appl. No.: 11/561,617

(22) Filed: Nov. 20, 2006

(65) Prior Publication Data

US 2007/0090061 A1 Apr. 26, 2007

Related U.S. Application Data

(62) Division of application No. 10/770,002, filed on Feb. 2, 2004, now Pat. No. 7,137,511.

(60) Provisional application No. 60/520,239, filed on Nov. 13, 2003, provisional application No. 60/448,650, filed on Feb. 18, 2003.

(51) Int. Cl.
*A47F 7/00* (2006.01)

(52) U.S. Cl. ..... 211/64; 211/4

(58) Field of Classification Search ..... 211/4, 211/8, 64, 60.1, 204, 206, 201; 42/94; 206/317; 224/913

See application file for complete search history.

(56) References Cited

U.S. PATENT DOCUMENTS 1,830,282 A * 11/1931 Lorch ..... 211/204
2,154,833 A * 4/1939 Curtiss ..... 211/204
2,312,955 A 3/1943 Camburn
2,472,022 A 5/1949 Neal
2,735,323 A 2/1956 Phillips
2,947,333 A 8/1960 Johnson
2,958,422 A * 11/1960 Caloiero et al. ..... 211/4
3,876,078 A * 4/1975 Gomes et al. ..... 211/64
3,917,071 A * 11/1975 Walters ..... 211/64
3,952,878 A * 4/1976 Gorham ..... 211/64
4,029,211 A * 6/1977 Marshall ..... 211/104
4,057,239 A 11/1977 Hopf et al.
4,132,315 A * 1/1979 Young ..... 211/4
4,461,385 A * 7/1984 Clouser ..... 211/4
4,852,780 A * 8/1989 Woodbury ..... 224/483
4,874,155 A 10/1989 Goul
4,893,801 A 1/1990 Flinn
4,893,810 A 1/1990 Lee
4,936,531 A * 6/1990 Bauser ..... 224/42.11
D334,524 S 4/1993 Pinkney
5,217,213 A 6/1993 Lii
5,282,303 A 2/1994 Schriever (Continued)

*Primary Examiner*—Jennifer E. Novosad
(74) *Attorney, Agent, or Firm*—Venable, Campillo, Logan & Meaney, P.C.

(57) ABSTRACT

The invention is summarized as mobile storage system for weapons and weapon accessories (generally referred to herein as the "mobile storage system"). The mobile storage system is a tool-less system that quickly, conveniently, compactly and securely stores shotguns, rifles, pistols, ammunition, and other accessories like binoculars and flashlights. The mobile storage system can "stand alone" on most any surface. One person can carry the mobile storage system with relative ease—even when the mobile storage system is fully loaded with weapons and weapon accessories. In addition, the mobile storage system can be mounted to the floor of a vehicle for secure transport. As such, the mobile storage system can be conveniently taken on a camping trip and set up inside a tent.

1 Claim, 17 Drawing Sheets

U.S. PATENT DOCUMENTS 5,568,916 A 10/1996 Gibbons et al.
D376,970 S 12/1996 Drake
5,617,962 A * 4/1997 Chen ..... 211/206
5,626,263 A 5/1997 Lii
5,709,372 A 1/1998 Lii
5,732,936 A 3/1998 Lii
5,755,342 A * 5/1998 Hoffman ..... 211/64
6,382,434 B1 * 5/2002 Silberg ..... 211/195
6,390,311 B1 * 5/2002 Belokin ..... 211/204
6,796,446 B2 * 9/2004 Segall et al. ..... 211/206
6,935,065 B1 * 8/2005 Oliver ..... 42/94
7,137,511 B1 * 11/2006 Crowell et al. ..... 211/4
2002/0121493 A1 * 9/2002 Wang ..... 211/195

* cited by examiner

MOBILE STORAGE SYSTEM FOR WEAPONS AND WEAPON ACCESSORIES

CROSS-REFERENCE TO RELATED APPLICATIONS

This application is a divisional of application Ser. No. 10/770,002, filed Feb. 2, 2004, which claims the benefit of provisional Application No. 60/520,239, filed Nov. 13, 2003, which claims the benefit of provisional Application No. 60/448,650, filed Feb. 18, 2003.

FIELD OF THE INVENTION

The present invention relates generally to weapon storage systems and, more specifically, to mobile weapon storage systems for weapons and weapon accessories.

BACKGROUND OF THE INVENTION

There are many types of weapon storage systems. There are also many types of clamping devices. Prior clamping devices have been disclosed in the following United States patents: U.S. Pat. No. 2,312,955 (E A Camburn), U.S. Pat. No. 2,472,022 (E C Neal), U.S. Pat. No. 2,735,323 (T D Phillips), U.S. Pat. No. 2,947,333 (A L Johnson), U.S. Pat. No. 4,057,239 (H Hopf et al.), U.S. Pat. No. 4,874,155 (A S Goul), U.S. Pat. No. 4,893,801 (R W Flinn), U.S. Pat. No. D334524 (K P Pinkney), U.S. Pat. No. 5,217,213 (L Lii), U.S. Pat. No. 5,282,303 (F G Schriever), U.S. Pat. No. 5,568,916 (R R Gibbons et al.), U.S. Pat. No. D376970 (J Drake), U.S. Pat. No. 5,626,263 (L Lii), U.S. Pat. No. 5,709,372 (L Lii), U.S. Pat. No. 5,732,936 (L Lii). None, however, disclose the aspects of the current invention.

SUMMARY OF THE INVENTION

The invention is summarized below only for purposes of introducing embodiments of the invention. The ultimate scope of the invention is to be limited only to the claims that follow the specification.

The invention is summarized as mobile storage system for weapons and weapon accessories (generally referred to herein as the "mobile storage system"). The mobile storage system is a tool-less system that quickly, conveniently, compactly and securely stores shotguns, rifles, pistols, ammunition, and other accessories like binoculars and flashlights. The mobile storage system can "stand alone" on most any surface. One person can carry the mobile storage system with relative ease—even when the mobile storage system is fully loaded with weapons and weapon accessories. In addition, the mobile storage system can be mounted to the floor of a vehicle for secure transport. As such, the mobile storage system can be conveniently taken on a camping trip and set up inside a tent.

The preferred embodiment of the mobile storage system has two basic configurations: the "dual long-barreled gun" configuration, and the "single long-barreled gun" configuration. Without the need for any tools, one can convert the dual long-barreled gun configuration to a single long-barreled gun configuration quickly and easily. Another preferred feature of the mobile storage system is the "quick-release" clamp. The quick-release clamp allows the user to secure and release a weapon almost instantaneously with one hand. For the purposes of this application, the term "weapon" broadly includes shotguns, rifles, assault rifles, bows, longbows, crossbows, AK-47s, pistols, spears or any other object that could be considered a weapon. Despite its quick clamp and quick-release ability, the quick-release clamp will keep a weapon secured to the mobile storage system even when the mobile storage system is mounted to a four-wheel drive vehicle and driven under extreme off-road conditions.

DESCRIPTIONS OF EMBODIMENTS

Figure 1:
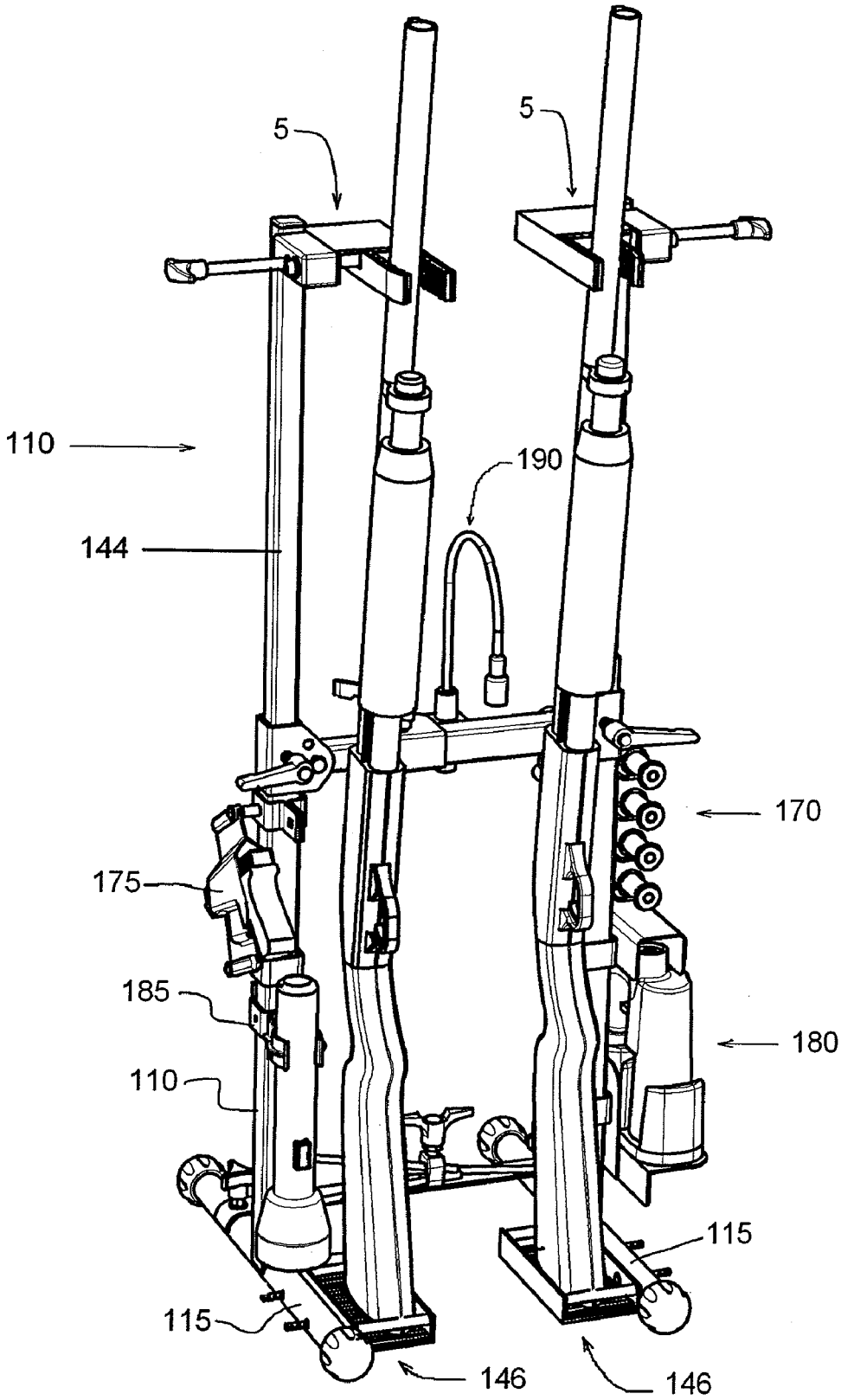
FIG. 1 illustrates a perspective view of the preferred embodiment of the mobile storage system in the dual long-barreled gun configuration.
Figure 2:
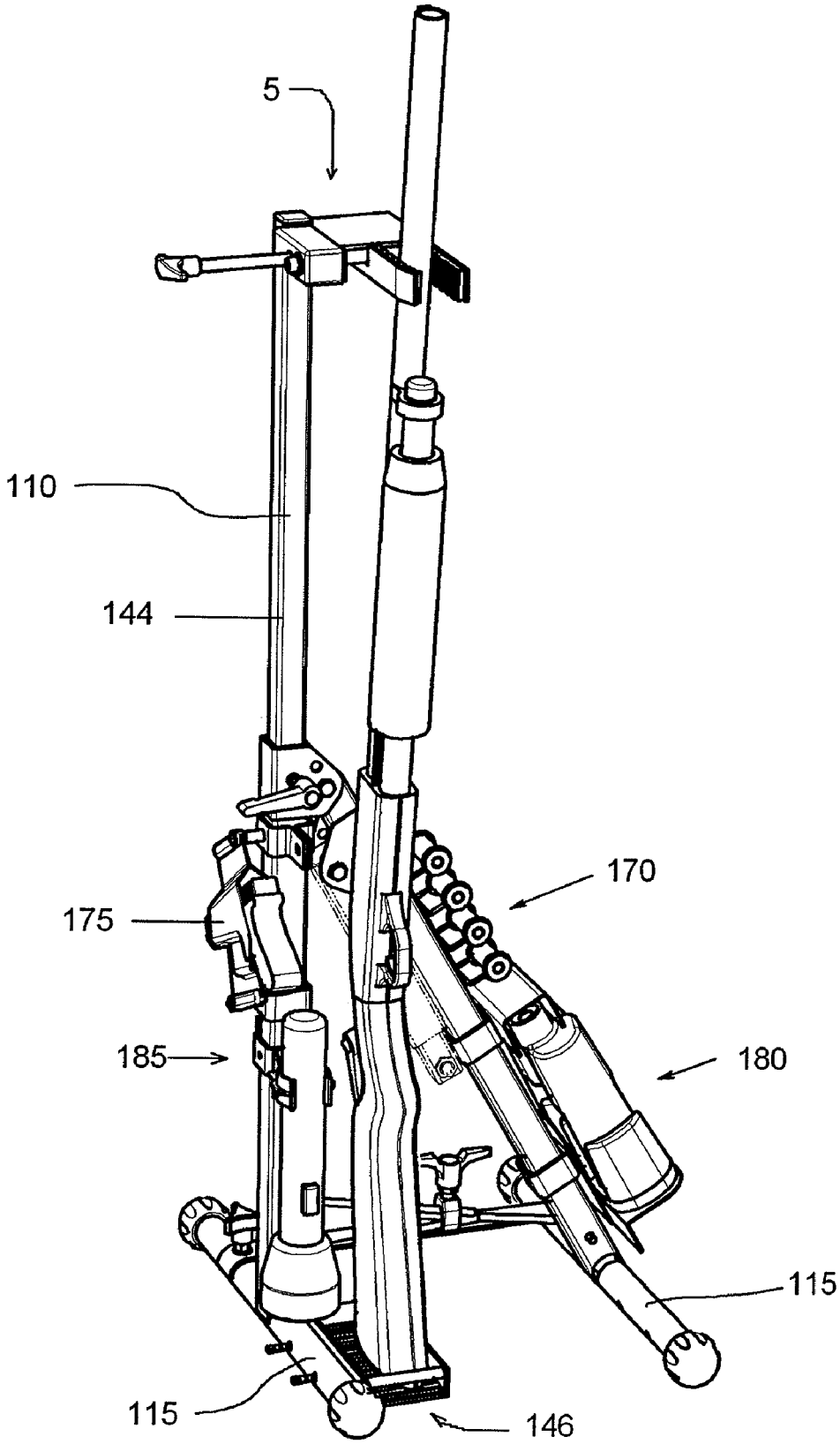
FIG. 2 illustrates a perspective view of then preferred embodiment of the mobile storage system in the single long-barreled gun configuration.

The descriptions that follow are intended to aid in the understanding but not limit the actual scope of the invention. It is to be understood that the descriptions below are merely illustrative of the presently preferred embodiments of the invention and that no limitations are intended to the detail of construction or design herein shown other than as defined in the appended claims. The descriptions that follow describe the intended and preferred use of each embodiment of the mobile storage system.

As used herein, "fastening means" includes threaded fasteners such as nuts and bolts, hook and pile fasteners, adhesives and epoxies, hooks, magnets, rivets, soldering, welding, surface tension, and nailing. Although it is preferred to construct the mobile storage system primarily from metal, other structural materials, such as wood, could also work. In this specification, the term "rod-locking collar" refers to any device that can be placed on a rod and locked to prevent the collar from moving along the rod. An example of a preferred rod-locking collar can be found on the website published by Newman Tools, Inc. at www.newmantools.com/gripfast/, which Newman Tools, Inc. offers for sale under the trademark GRIP FAST. In this specification, the term "quick-release clamp" refers to any clamp where the object being held by the clamp can be immediately released from the clamp by the push of a button or similar activation device.

Broadly, the preferred embodiment of the mobile storage system comprises a convertible frame 110, two quick-release weapons clamping systems, an ammunition holder assembly 170, a pistol holder assembly 175, a binocular holder assembly 180, a flashlight holder assembly 185, and an infrared light attachment 190. Alternative embodiments of the mobile storage system include the convertible frame 110 with a combination of additional features, including one or more quick-release weapon clamping systems, an ammunition holder assembly 170, a pistol holder assembly 175, a binocular holder assembly 180, a flashlight holder assembly 185, and an infrared light attachment 190. It is envisioned that the mobile storage system could be sold as a kit or in separate pieces. The mobile storage system can be assembled in any of its various configurations and combinations without any tools.

Figure 3A:
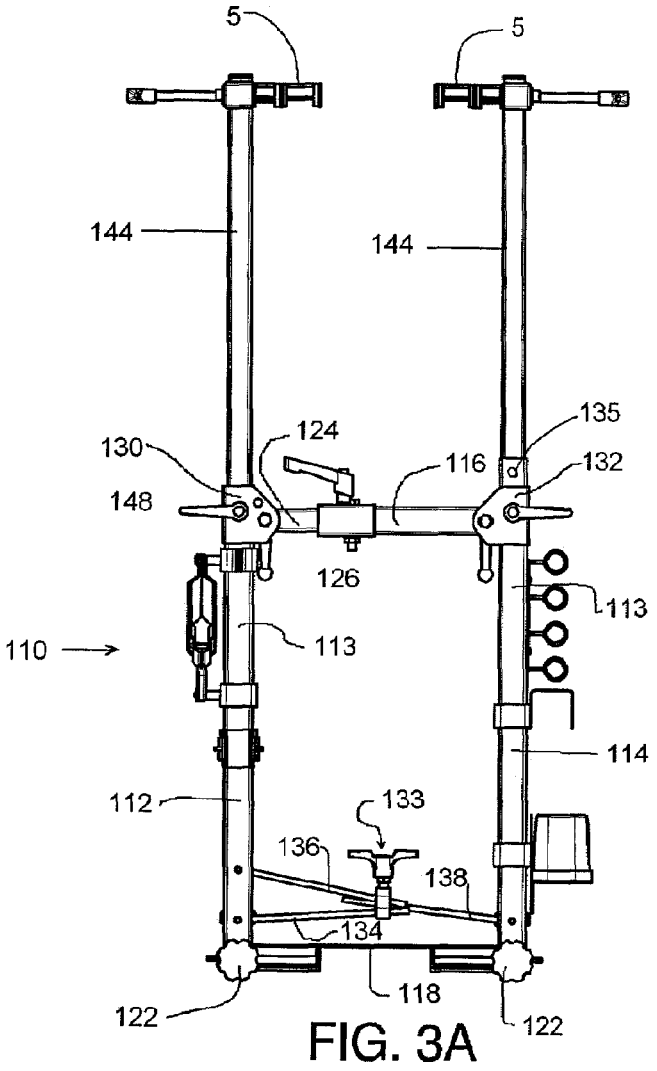
FIG. 3A illustrates a front view of the preferred embodiment of the convertible frame 110 in the dual long-barreled gun configuration.
Figure 3B:
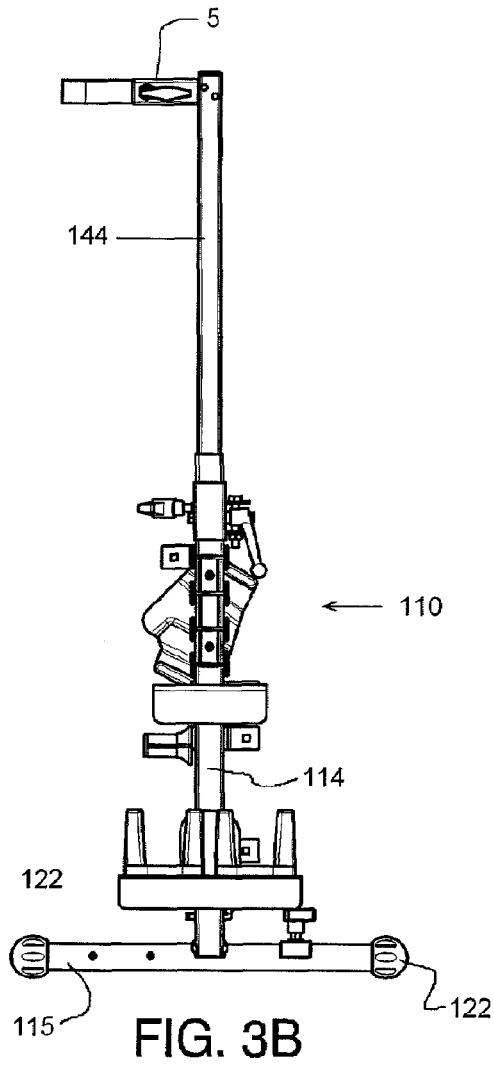
FIG. 3B illustrates a side view of the preferred embodiment of the convertible frame 110 in the dual long-barreled gun configuration.

As shown in FIGS. 3A and 3B, the preferred embodiment of the convertible frame 110 comprises a left frame 112, a right frame 114, a convertible horizontal member 116, a base strap 118 and a frame stability assembly 133. The left frame 112 and right frame 114 each further comprise a vertical member 113 and a base member 115. It is preferred that the vertical member 113 be made from square tube steel. It is preferred that the base member 115 be made from round tube steel. It is also preferred that each end of the base member 115 have an end cap 122 made of rubber or rubber-like material. A preferred example of an end cap is a product sold by Work Force under the trademark Work Force®. It is preferable to rigidly connect the bottom end of the vertical member 113 to the middle of the base member 115 by welding, although other suitable fastening means can be employed.

Figure 11:
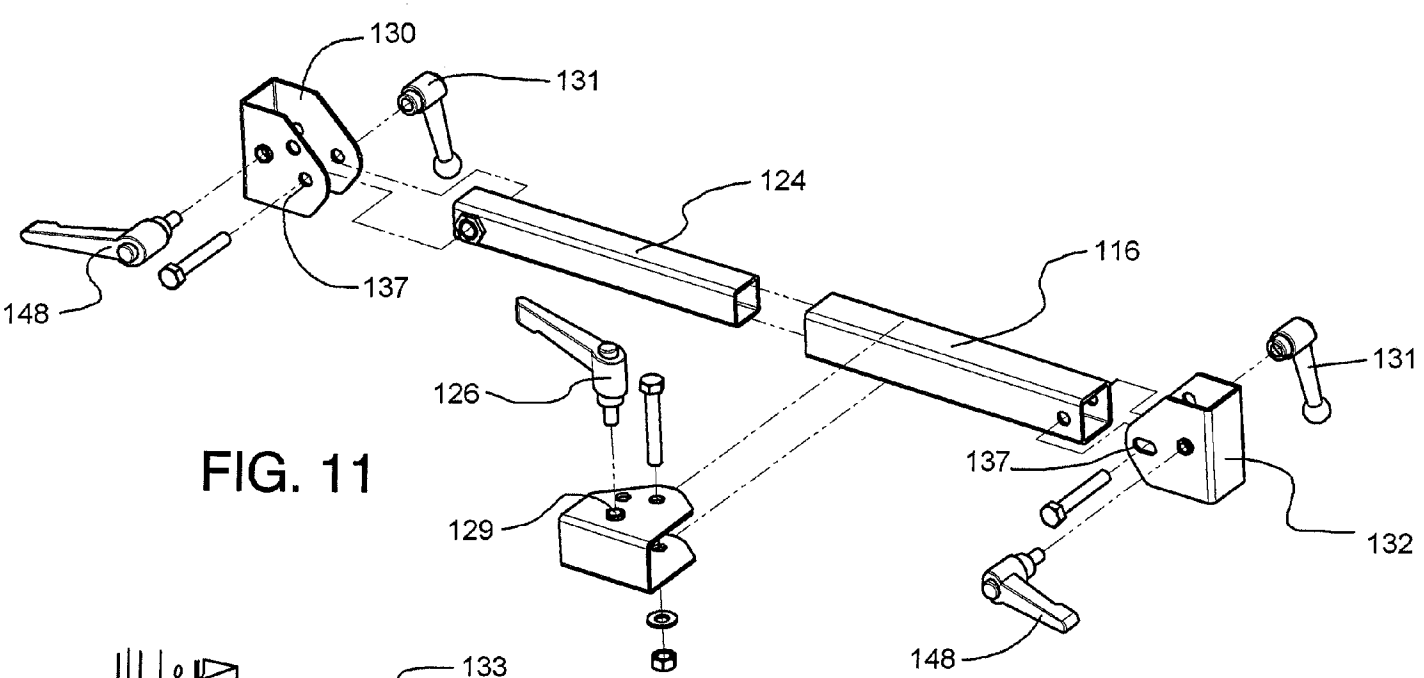
FIG. 11 illustrates an exploded view of the preferred embodiment of the convertible horizontal member 116.

The convertible horizontal member 116 can be made from many materials in many shapes. It is preferred that the convertible horizontal member 116 be constructed from square tube steel. It is also preferred that the convertible horizontal member 116 be adjustable in length. This adjustability can be accomplished in many ways, but as shown in FIG. 11, it is preferred that that the convertible horizontal member further comprise an extendable length member 124. It is preferred that the extendable length member 124 also be made from square tube steel of a size that can be inserted into the convertible horizontal member 116 and secured by a ratcheting friction clasp 126, wherein the ratcheting friction clasp 126 is connected to a horizontal bracket 128 and inserted through a horizontal member hole 129. While many ratcheting friction clasps may work, a preferred example is a product sold by Elesa under the identification of Model MR.

Figure 12:
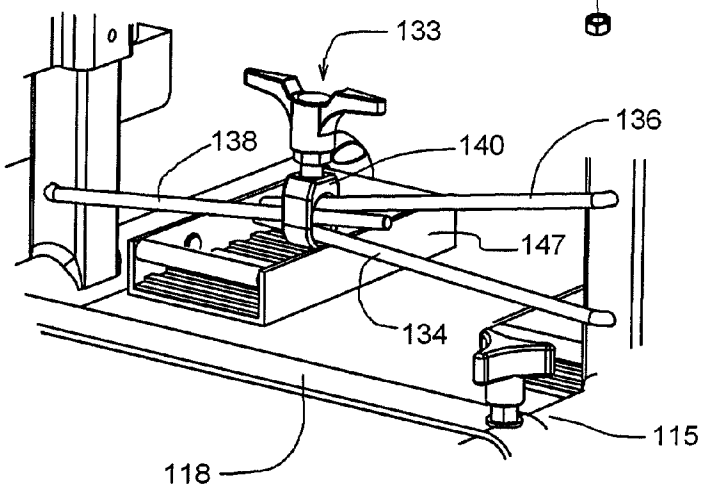
FIG. 12 illustrates an enlarged view of the frame stability assembly 133.

As shown in FIG. 12, the base strap 118 can be made from flat stock metal. A hole through each end of the base strap 118 accepts a nut and bolt assembly to connect the base strap 118 to the base members 115. It is preferred that the nut used to secure the base strap 118 be big enough that is can be tightened by hand. A preferred example such a nut is a product sold by Elesa under the identification number Model 6335. It is preferred to mount the mobile storage system to the floor of a vehicle, such as a Ford® F-150, truck using fasteners such as bolts and nuts through the base strap 118, the horizontal members 115, or both, to the floor of the vehicle. Many other configurations and fasteners can be used to mount the mobile storage system to the F-150 or other vehicles with the base strap 118 or other parts of the mobile storage system common to those in the industry.

It is preferred that the convertible horizontal member 116 be releasably connected to the left frame 112 and pivotably connected to the right frame 114. As shown in FIG. 3A and FIG. 11, a left bracket 130, having bracket holes 137, can be connected to the vertical member 113 of the left frame 112 to accept the extendable length member 124. A removable nut and bolt assembly 131 can be employed to releasably connect the extendable length member 124 to the bracket hole 137 in the left bracket 130. Once either side is released, the other side can pivot about the removable nut and bolt assembly 137. A right bracket 132 can be connected to the vertical member 113 of the right frame 114 to accept the convertible horizontal member 116 in a similar fashion. It is preferred to connect the right bracket 132 to the vertical member 113 of the right frame 114 below the top of the vertical member 113 so that approximately the top 4 inches of the vertical member 113 remains clear to allow for a hole 135 as shown in FIG. 3A for conversion to the single long-barreled gun configuration as explained in more detail later.

Figure 4A:
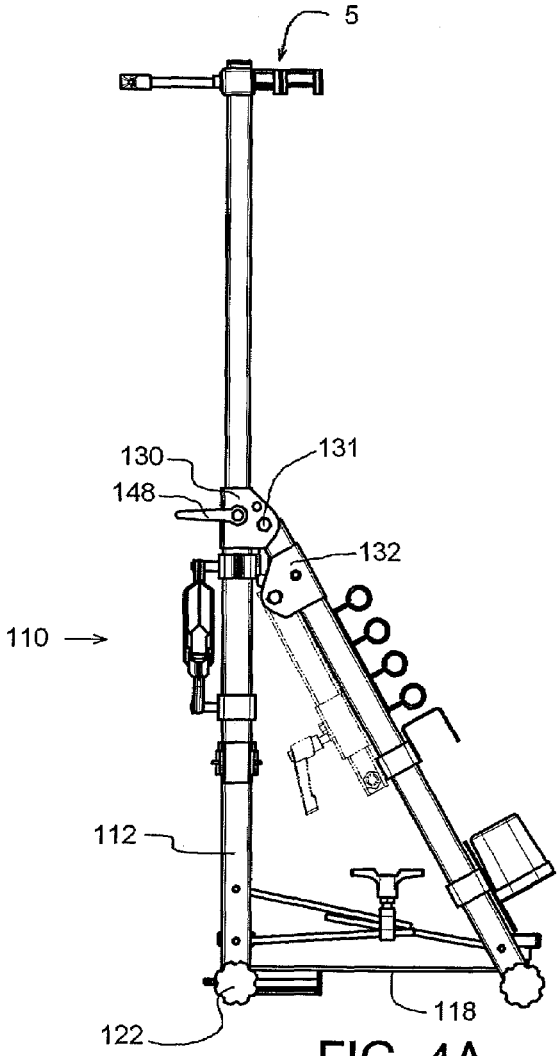
FIG. 4A illustrates a front view of the preferred embodiment of the convertible frame 110 in the single long-barreled gun configuration.
Figure 4B:
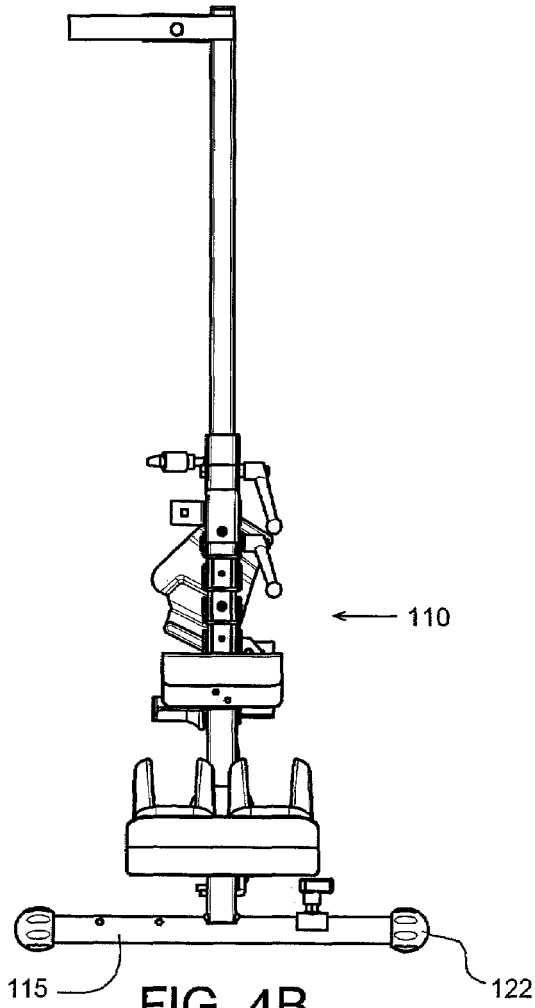
FIG. 4B illustrates a side view of the preferred embodiment of the convertible frame 110 in the single long-barreled gun configuration.

In the single long-barreled gun configuration, the nut and bolt 131 is removed from the left end of the extendable length member 124. The convertible horizontal member 116 and the extendable length member 124 are left to hang down parallel to the vertical member 113 of the right frame 114. The vertical member 113 of the right frame 114 is then rotated along the longitudinal axis of the base member 115 of the right frame 114 until the hole 135 (see FIG. 3A) is aligned with the bracket holes 137 in the left bracket 130 so that the nut and bolt 131 can be inserted through the hole 135 as shown in FIG. 4A.

The frame stability assembly 133 can be constructed in a variety of ways. As shown in FIG. 12, it is preferred that the frame stability assembly 133 comprises a first rod 134, a second rod 136, a third rod 138 and a multi-rod clamp 140. While many clamps may work, a preferred example is a clamp sold by Reos. The first, second and third rods are "J" shaped as shown in FIG. 12. The first rod 134 is inserted through a hole in the vertical member 113 of the left frame 112 and allowed to rotate freely about an axis perpendicular to the vertical member 113 of the left frame 112. The second rod 136 is also inserted though a hole in the vertical member 113 of the left frame 112 and allowed to rotate freely about an axis perpendicular to the vertical member 113 of the left frame 112. It is preferred to insert the second rod 136 through a hole in the vertical member 113 of the left frame 112 wherein the hole is approximately four inches above the hole for the first rod. The third rod 138 is inserted though a hole in the vertical member 113 of the right frame 114 and allowed to rotate freely about an axis perpendicular to the vertical member 113 of the right frame 114. It is preferred that the third rod 138 be inserted into the vertical member 113 of the right frame 114 at a height between the height of the hole for the first rod 134 and the hole for the second rod 136. Once inserted in their respective holes, the first rod, second rod and third rods are inserted through the multi-rod clamp 140. In operation, the multi-rod clamp 140 is tightened once the mobile storage system has been configured in either the dual long-barreled gun or the single long-barreled gun configuration to add stability.

The quick-release weapon clamping system comprises a quick-release clamp 5, an adjustable extension piece 144 and a weapon shelf 146. The quick-release clamp 5 can be rigidly connected to the adjustable extension piece 144 by a screw or other suitable fastening means. It is preferred that the adjustable extension piece 144 be made out of square tube steel of a size so that it can be inserted into the top end of the vertical member 113. A ratcheting screw clamp 148 can be connected to the bracket 130 at the top end of the vertical member 113 and inserted through a hole in the vertical member 113, allowing the adjustable extension piece 144 to slide vertically and lock at any height so that the quick-release clamp 5 can be set at a variable height.

As shown in FIGS. 5A-5E, the quick-release clamp 5 generally comprises a frame 10, a sliding plate 20, two alignment rods 26, 28, a closing rod 32, and a rod-locking assembly 40. It is preferred that the frame 10 take the shape of a rectangular tube, having a first opposing side 12, a second opposing side 14, a first tube end 16, a second tube end 18, and a fixed plate 24. Preferably, the fixed plate 24 is an extension of the first opposing side 12 beyond the first tube end 16 of the frame 10. The fixed plate 24 can be connected to the frame 10 near the first tube end 16 and protrudes from the frame 10 in a plane substantially parallel to the opposing sides 12, 14 (the first opposing side 12 and the second opposing side 14 are sometimes collectively referred to herein as the "opposing sides"). It is preferred to cast the frame 10 and the fixed plate 24 from metal as one piece. It is also preferred that the frame 10 and fixed plate 24 be approximately ⅛ inch thick.

The first alignment rod 26 and the second alignment rod 28 (the first alignment rod 26 and the second alignment rod 28 are sometimes collectively referred to herein as the "two alignment rods") are connected to the opposing sides 12, 14 and aligned roughly perpendicular to the opposing sides 12, 14. It is preferred that the first opposing side 12 and the second opposing side 14 be substantially parallel to each other.

The sliding plate 20 is oriented in a plane substantially parallel to the fixed plate 24. The sliding plate 20 has holes for the two alignment rods 26, 28 that permit the sliding plate 20 to slidably pass over the two alignment rods 26, 28. The two holes of the sliding plate 20 should be marginally bigger than the outside diameter of each alignment rod 26, 28 so that the sliding plate 20 can slide over the alignment rods. Inserting a flange bushing, preferably from teflon or similar material, into each of the two holes of the sliding plate 20 assists in a smooth sliding of the sliding plate 20 over the alignment rods 26, 28. It is has been found that using an alignment rod of ¼ inch diameter, a hole in the sliding plate 20 of 5/16 inch diameter, and using a flange busing having a cylindrical wall thickness of 1/16 inch permits the sliding plate 20 to slide but not have too much "play" on the alignment rods 20, 22.

Figure 5A:
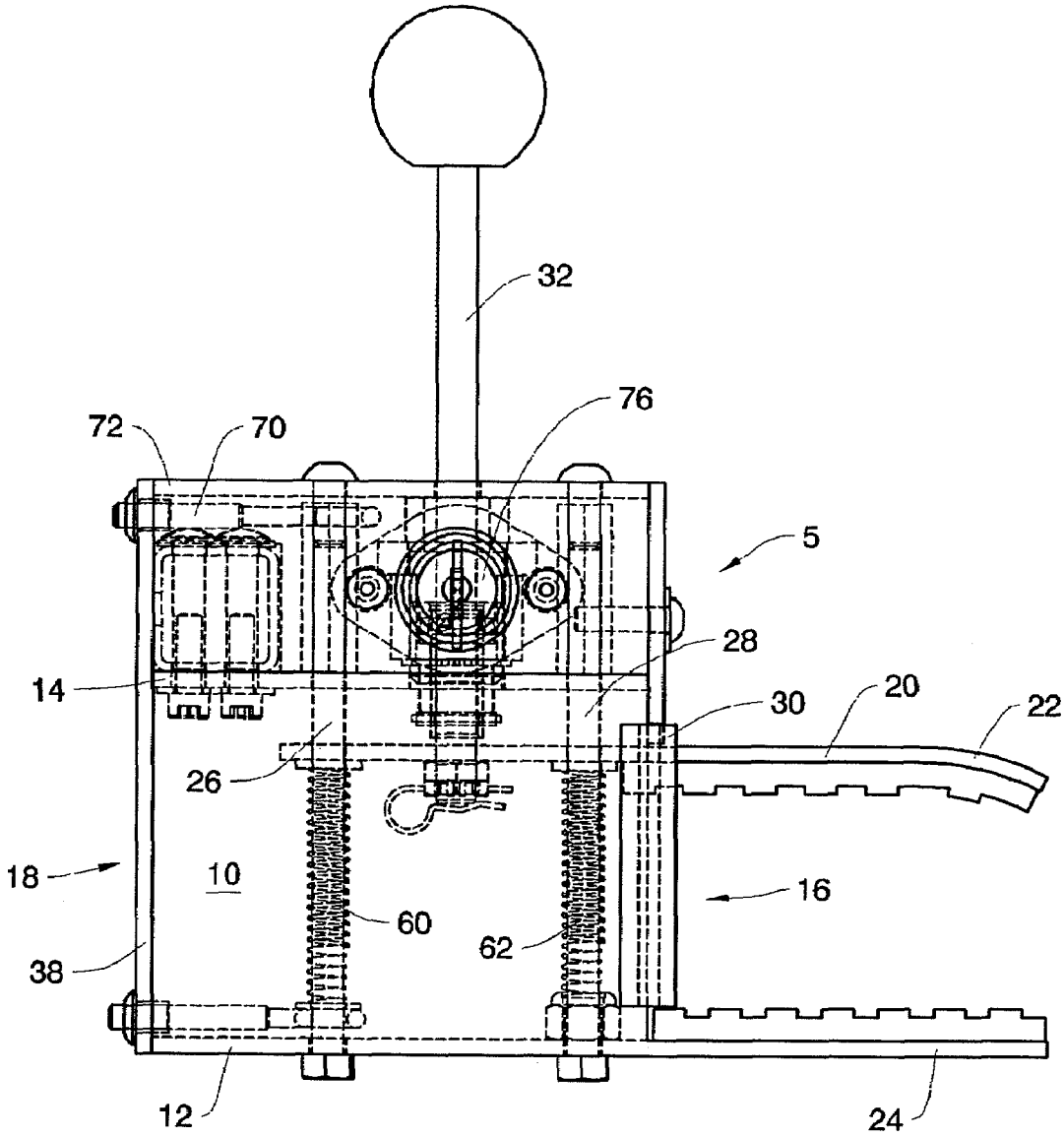
FIG. 5A illustrates a preferred embodiment of the quick-release clamp 5 with interior elements and mechanisms shown with dotted lines.
Figure 5B:
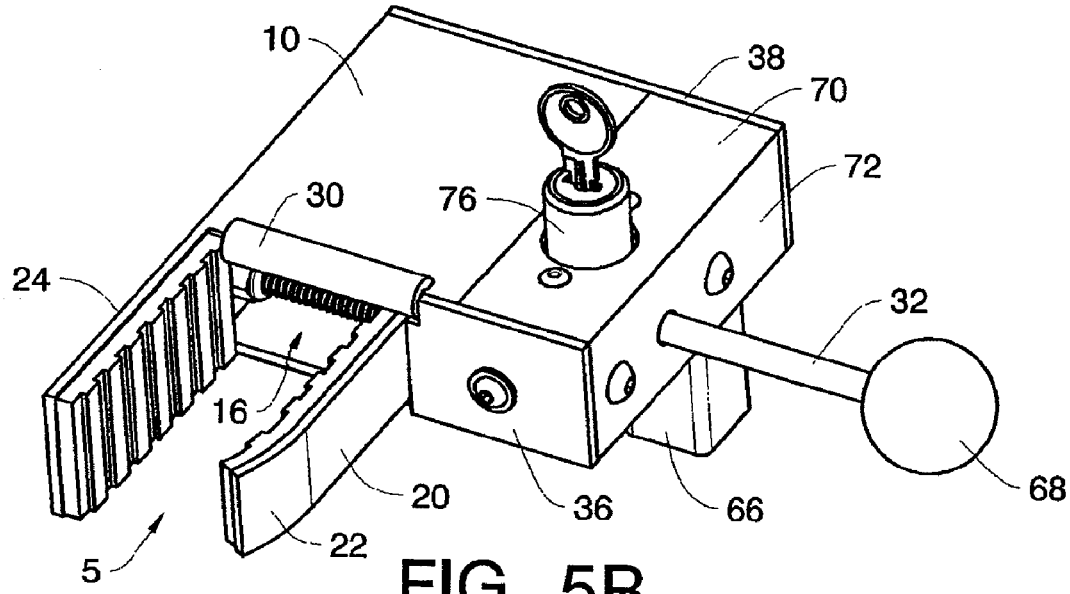
FIG. 5B illustrates a top view of a preferred embodiment of the quick-release clamp 5 without interior elements and mechanisms shown with dotted lines.
Figure 5C:
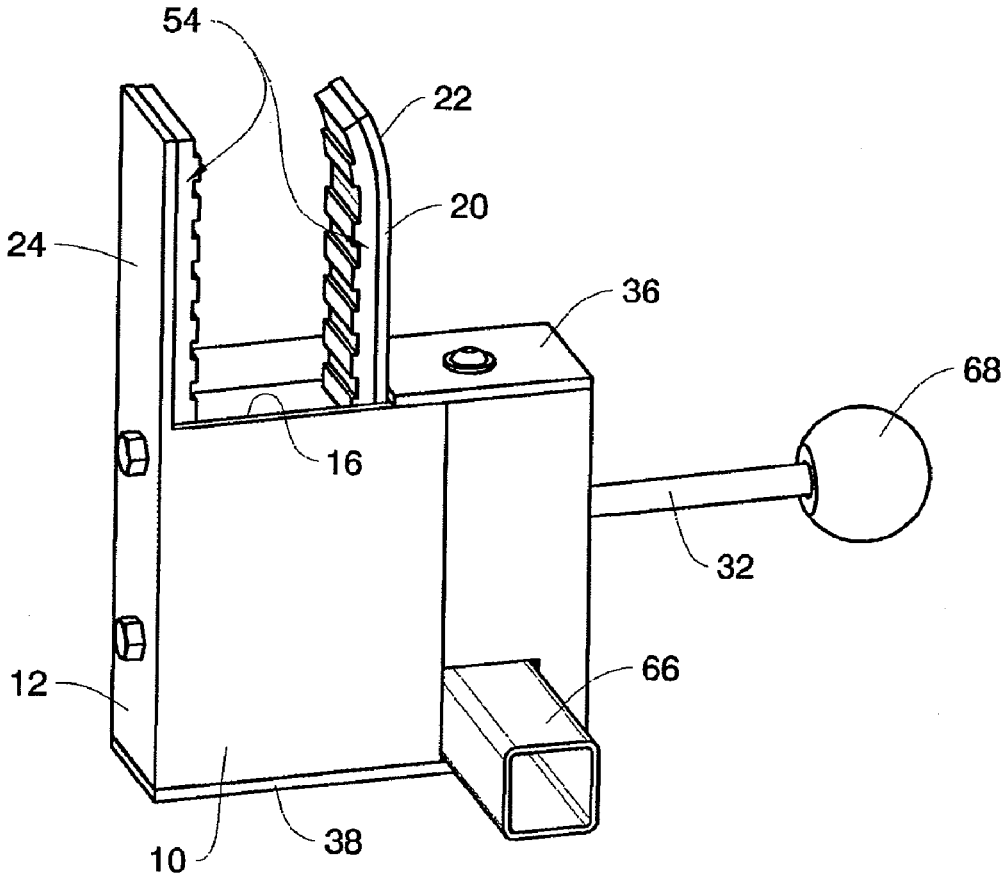
FIG. 5C illustrates a bottom view of the preferred embodiment of the quick-release clamp 5 shown in FIG. 5B.
Figure 5D:
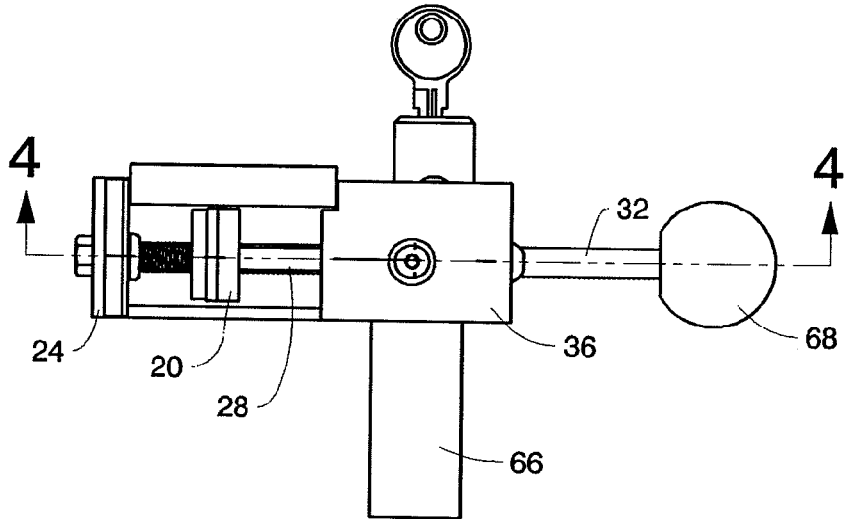
FIG. 5D illustrates a front view of the preferred embodiment of the quick-release clamp 5.
Figure 5E:
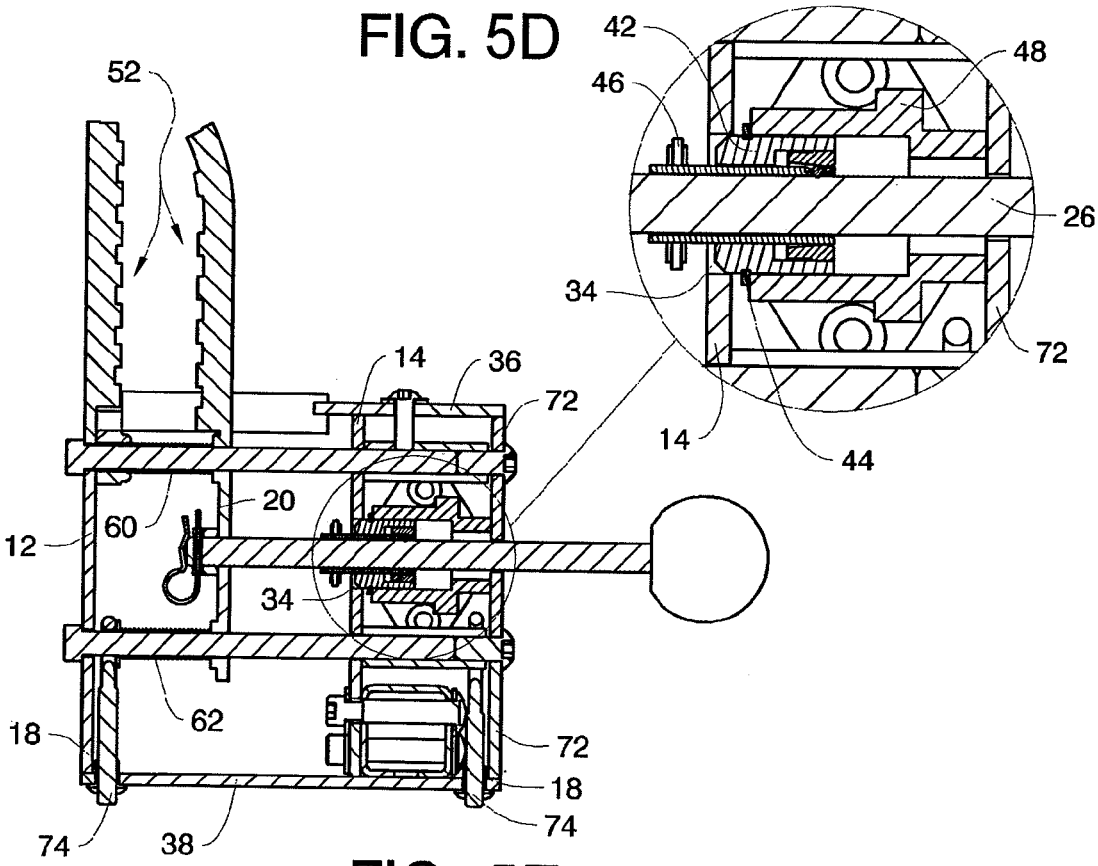
FIG. 5E illustrates section 4-4 of FIG. 5D.

The sliding plate 20 protrudes through the first tube end 16 in a direction substantially parallel to the fixed plate 24. The sliding plate 20 should extend past the first tube end 16 to create a gripping surface 52 as shown in FIG. 5A. It is preferred that the gripping surface 52 of the sliding plate 20 be the roughly the same size as the fixed plate 24. It is optionally preferred that the tip of the sliding plate 20 have a curved end 22 as shown in FIG. 5A. It is also preferred that the sliding plate 20 be approximately 6 inches long with 3 inches extending beyond the first tube end 16. Another option is to fasten rubber padding 54 (see e.g., FIG. 5C), preferably ribbed rubber padding 54, to the inside faces of the sliding plate 20 and the fixed plate 24. A rubber guard 30 can be added along the first tube end to cushion any clamped object from banging against the first tube end 16. Both the rubber padding 54 and the rubber guard 30 can be glued to the quick-release clamp 5.

The closing rod 32 is connected to the sliding plate 20 between the two alignment rods 26, 28, preferably at a point substantially equidistant between the two alignment rods 26, 28. The closing rod 32 should be aligned substantially parallel to the alignment rods 26, 28. A hole 34 in the second opposing side 14 permits the closing rod 32 to slidably pass through the second opposing side 14. It is preferred that the hole 34 be marginally bigger than the diameter of the rod-locking clamp 42 to allow the rod-locking clamp 42 to pass through the hole 34 for easier assembly of the clamp 5.

It is preferred that the rod-locking assembly 40 has a first position 56 and a second position 58. In the first position 56 (the "rod unlocked position"), the rod-locking assembly 40 permits the closing rod 32 to move the sliding plate 20 in two directions: toward the fixed plate 24 and away from the fixed plate 24. In the second position 58 (the "rod locked position"), the rod-locking assembly 40 permits the closing rod 32 to move the sliding plate only in one direction: toward the fixed plate 24.

The rod-locking assembly 40 can be configured in a variety of ways. It is preferred, however, that the rod-locking assembly comprise a rod-locking clamp 42 fixed to the second opposing side 14 and a ring tab 46 attached to the locking clamp for activating the release mechanism of the locking clamp. It is preferred to use a rod-locking clamp having a 5/16-inch rod size sold under the trademark GRIP FAST by Newman Tools, Inc. Additional information regarding the preferred rod-locking clamp can be found in U.S. Pat. No. 4,893,810 (Lee).

The preferred way to fix the rod-locking clamp 42 to the second opposing side 14 is by using a retaining ring 44. The retaining ring 44 can be added to the rod-locking clamp 42 by scoring a channel around the outside circumference of the rod-locking clamp and snapping in a metal ring to fit in the scored channel. By adding a retaining ring 44 around the outside circumference of the rod-locking clamp 42, the retaining ring can keep the rod-locking clamp from passing through the closing rod hole 34 when the closing rod 32 is depressed. The retaining ring 44 can be fastened to the second opposing side 14 by any suitable means, such as a screw. Fastening the retaining ring 44 to the second opposing side 14 keeps the rod-locking clamp 42 from moving in any direction.

Rather than fastening the retaining ring 44 to the first opposing side, however, it is preferred to enclose the rod-locking assembly in a housing 70. By enclosing the rod-locking assembly in a housing 70, the wall of the housing can be used to keep the retaining ring 44 in contact with the second opposing side 14 by the use of a spacer 48. It is preferred that the spacer be made of plastic and formed so that it fits over the rod-locking clamp 42 and extends until it touches the third opposing side 72. In other words, the combination rod-locking clamp 42 and spacer 48 is kept from moving on one side by the retaining ring 44 that bears on the second opposing side 14 and kept from moving on the other side by the third opposing side 72 of the housing 70.

Figure 5F:
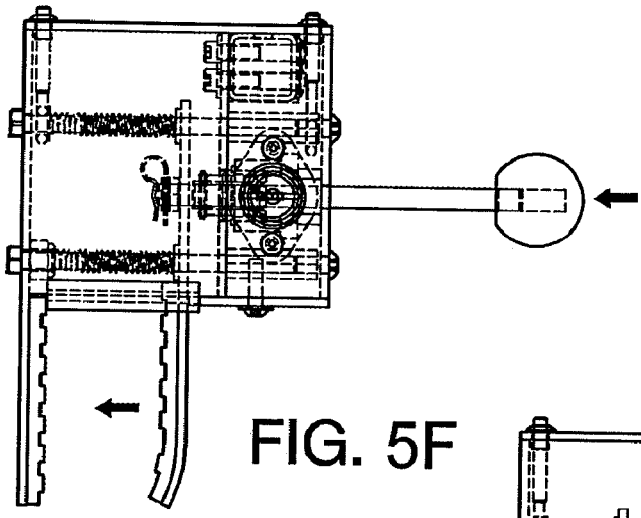
FIG. 5F illustrates a preferred embodiment of the quick-release clamp 5 in the open position.
Figure 5G:
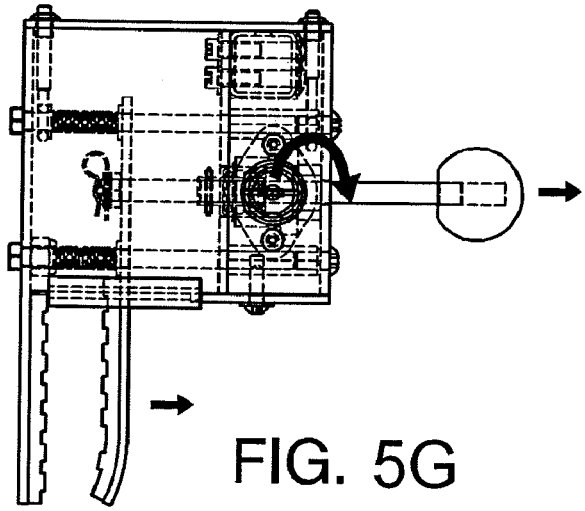
FIG. 5G illustrates a preferred embodiment of the quick-release clamp in the partially closed position.
Figure 5H:
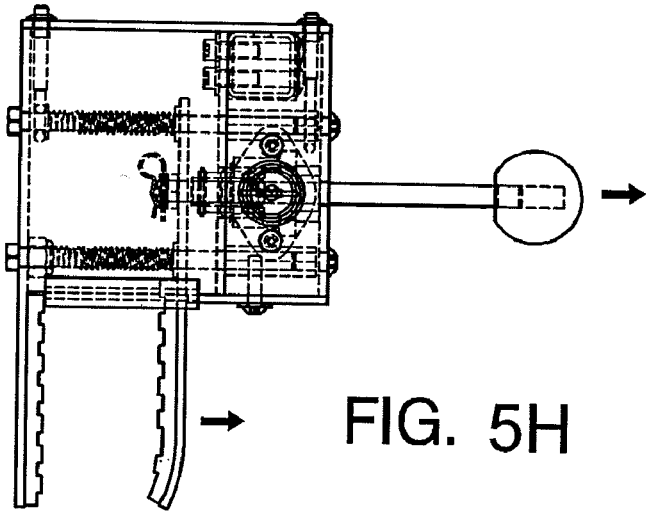
FIG. 5H illustrates a preferred embodiment of the quick-release clamp 5 in the open position.
Figure 5J:
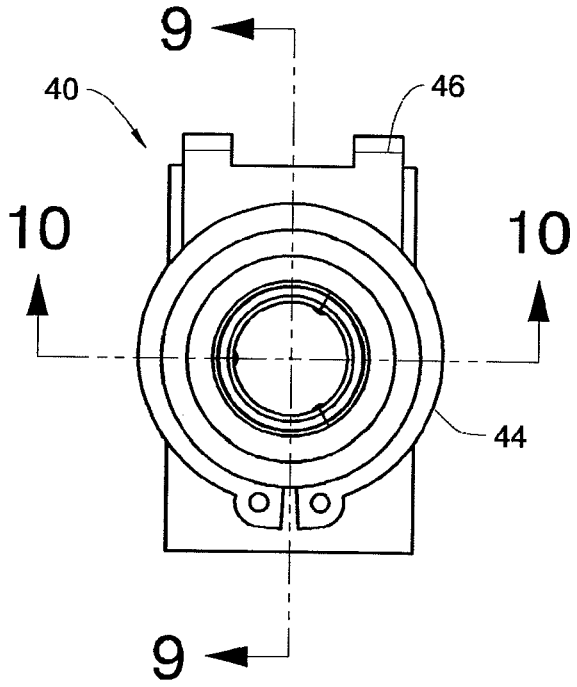
FIG. 5J illustrates an axial view of a preferred embodiment of a rod-locking assembly 40 in the "rod-locked" or second position.
Figure 5K:
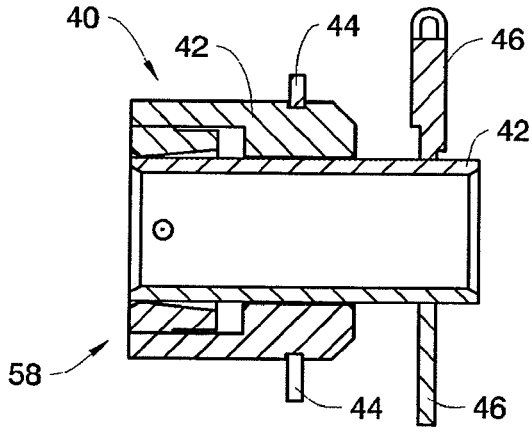
FIG. 5K illustrates section 9 from FIG. 5J.
Figure 5L:
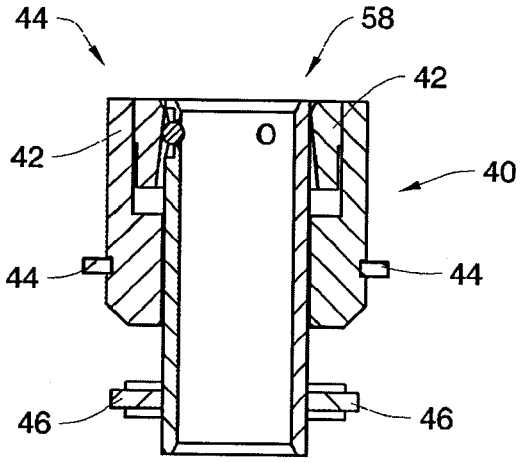
FIG. 5L illustrates section 10 from FIG. 5J.
Figure 5M:
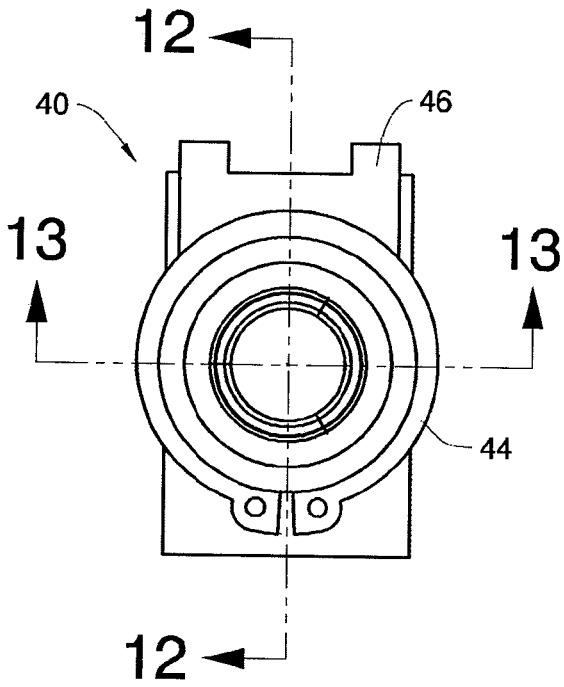
FIG. 5M illustrates an axial view of a preferred embodiment of a rod-locking assembly 40 in the "rod-unlocked" or first position.
Figure 5N:
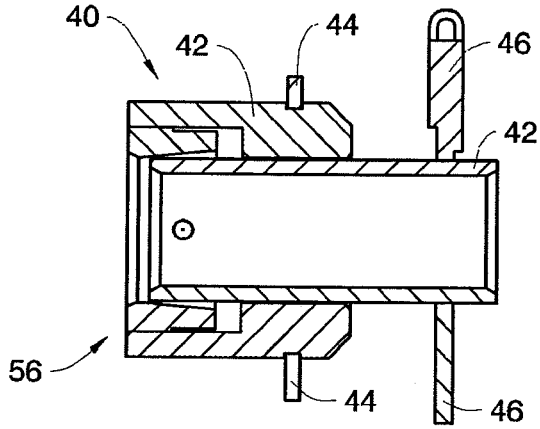
FIG. 5N illustrates section 12 from FIG. 5M.
Figure 5O:
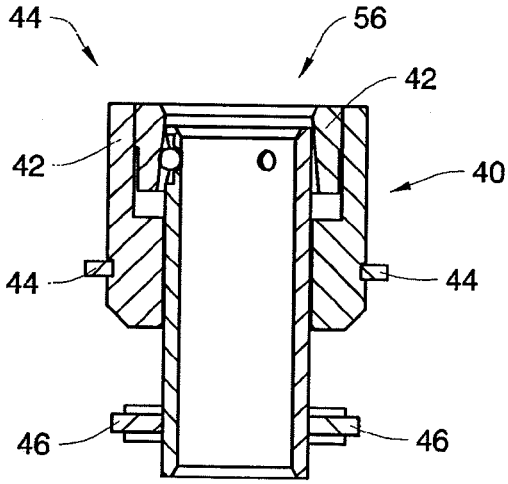
FIG. 5O illustrates section 13 from FIG. 5M.
Figure 5P:
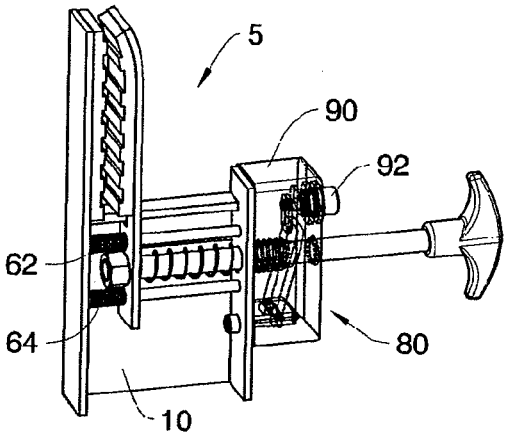
FIG. 5P illustrates an alternative embodiment of the quick-release clamp 5 in the closed position.
Figure 5Q:
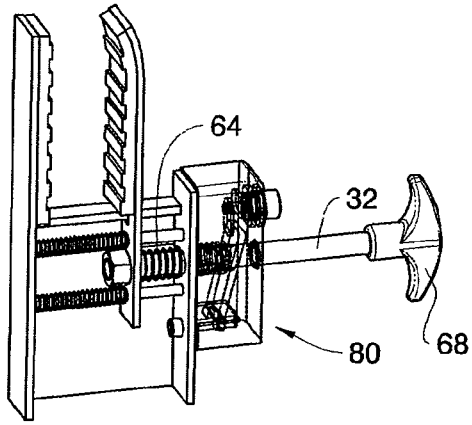
FIG. 5Q illustrates an alternative embodiment of the quick-release clamp 5 in a partway-closed position.
Figure 5R:
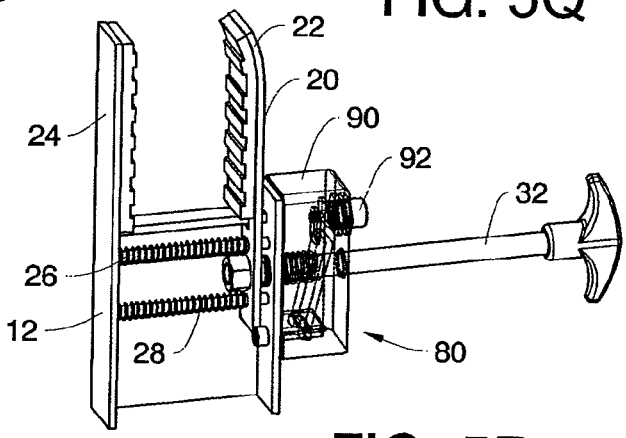
FIG. 5R illustrates an alternative embodiment of the quick-release clamp 5 in the open position.

In the preferred embodiment, the rod-locking clamp 42 is converted from the second position 58 to the first position 56 by the activation of the ring tab 46. Activation of the ring tab 46 (i.e., moving the ring tab linearly in a direction away from the retaining ring 44, releases the rod-locking clamp's grip on the closing rod 32. Without the optional housing 70 (or by leaving an opening in the optional housing 70), the ring tab 46 can be activated directly by hand. If desired, the ring tab 46 can be activated by mechanical means. There are many ways known in the art to mechanically activate the ring tab 46. It is preferred, however, to utilize a keyed-locking mechanism 76 as shown in FIGS. 5F-5H to activate the ring tab 46 and so that not only is the ring tab 46 mechanically activated, but the key-locking mechanism 76 adds the capability of preventing the rod-locking clamp 42 from unintentionally being moved into the second position 58.

The quick-release clamp 5 can optionally include a releasing spring 60, 62. The releasing spring 60, 62 is preferably placed over one or more alignment rods between the fixed plate 24 and the sliding plate 20. The purpose of the releasing spring is to spring the sliding plate back in the open position when the ring tab 46 is activated (switching the rod-locking assembly from the first position to the second position) in the closed or partially closed position. The releasing spring 60, 62 can provide the "quick-release" effect of the quick-release clamp.

An optional example of a rod-locking assembly 40 is illustrated in FIGS. 5P-5T. Preferably, the optional rod-locking assembly 80 comprises a locking plate 82 having an aperture through which the closing rod 32 can slide. The nose 84 of the locking plate is pivotably connected to one leg of an angle 86, with the other leg of the angle 86 being fixed to the second opposing side 14 by a fastening means, preferably a screw. A biasing spring 88 allows the locking plate to frictionally keep the closing rod 32 from moving in the direction that would increase the distance between the sliding plate 20 and the fixed plate 24 unless the end of the locking plate 82 opposite from the nose 84 is depressed. If the locking plate 82 is depressed, the releasing springs 60, 62 immediately move the sliding plate 20 into the open position.

Figure 5S:
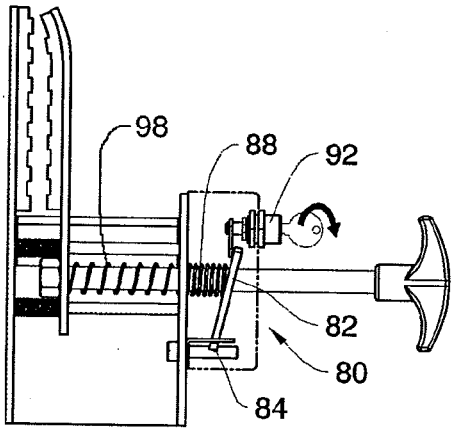
FIG. 5S illustrates an alternative embodiment of the quick-release clamp 5 with an optional locking device in the locked position.
Figure 5T:
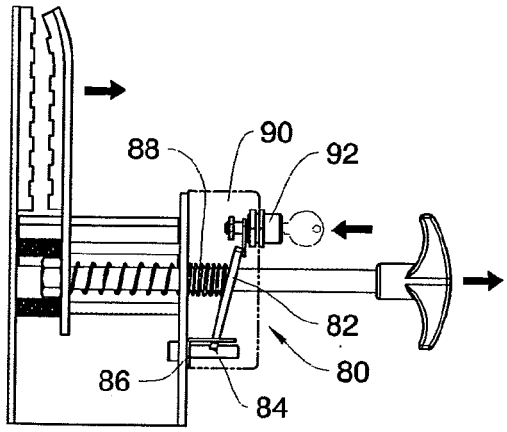
FIG. 5T illustrates an alternative embodiment of the quick-release clamp 5 with an optional locking device in the unlocked position.

The optional rod-locking assembly 80 can be enclosed by a case 90 having a button 92 for depressing the locking plate 82. The button 92 can also be capable of being locked with a key so that the locking plate 82 cannot be depressed as illustrated in FIG. 5S.

The quick-release clamp 5 can optionally have a damping spring 98 placed over the closing rod 32 between the sliding plate 20 and the second opposing side 14. The purpose of the damping spring 98 is to soften the impact of the sliding plate on the frame 10 after activation of the releasing spring 60, 62. However, it has been found that a damping spring 98 is not necessary.

The quick-release clamp 5 can optionally have a front cover plate 36 and a back cover plate 38. The front cover plate 36 and the back cover plate 38 can be connected to the quick-release clamp 5 by an eye hook screw and nut assembly 74 or other suitable fastening means. The quick-release clamp 5 can optionally have a knob 68 for a more comfortable grip. The quick-release clamp 5 can also have a mounting tube 66 connected to the frame 10 or other suitable location so that the quick-release clamp 5 can be mounted to another object like a wall or another frame.

Figure 8:
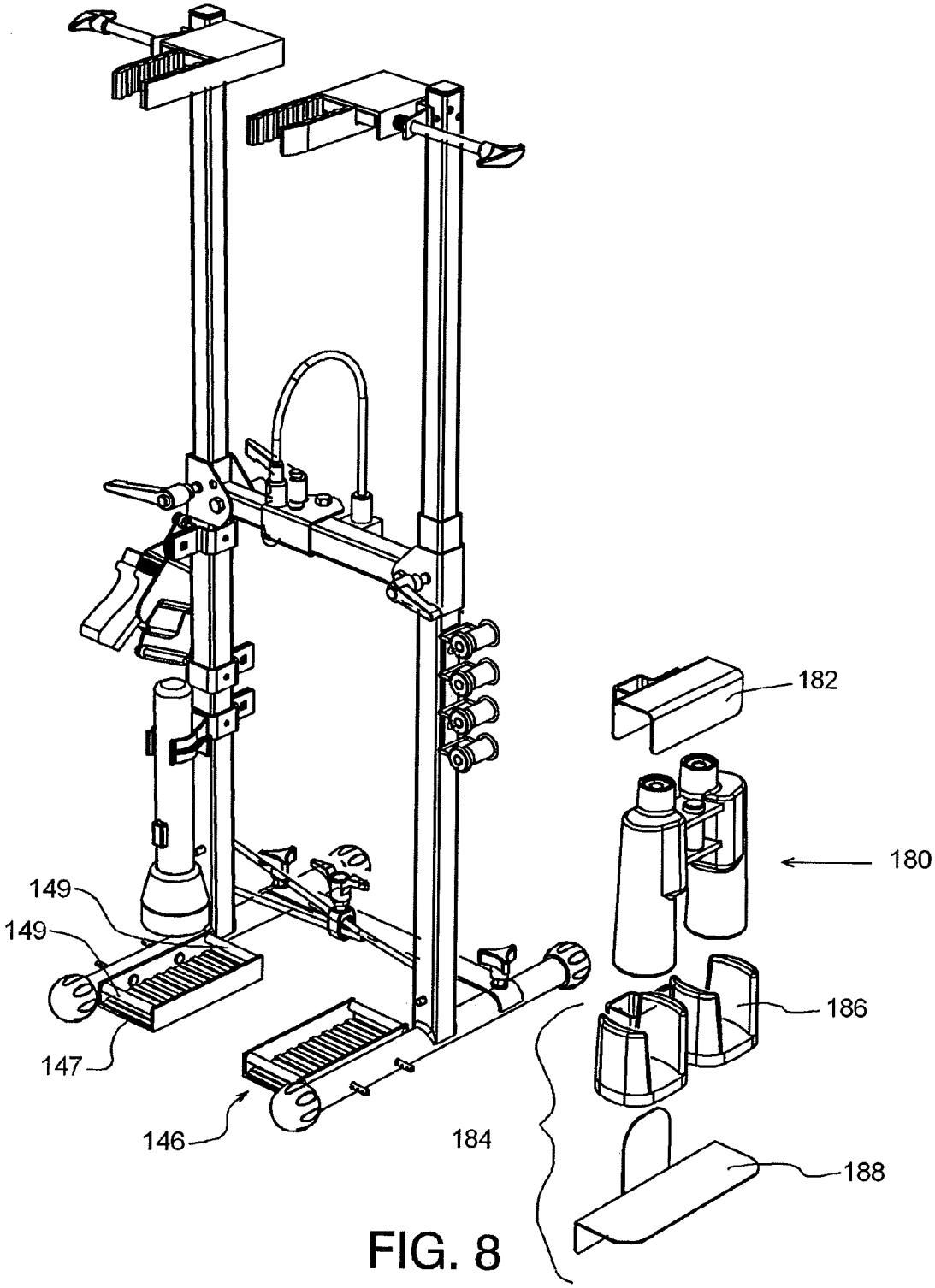
FIG. 8 illustrates an exploded view of the preferred embodiment of the binocular holder assembly 180.

As shown in FIG. 8, the weapon shelf 146 comprises a rigid base 147 and at least two bolt and nut assemblies 149. The rigid base 147 is preferred to be in the shape of a channel as shown in FIG. 12. Each bolt and nut assembly 149 can be inserted through a hole in each leg of the channel and the weapon shelf 146. The purpose of the nut and bolt assembles 149 is to keep the butt end of the weapon from sliding along the length of the weapon shelf 146. The weapon shelf 146 is then fastened to a base member 115 by suitable fastening means, preferably clevis pin assembly wherein the pin can be removed or inserted by hand.

Figures 6A, 6B:
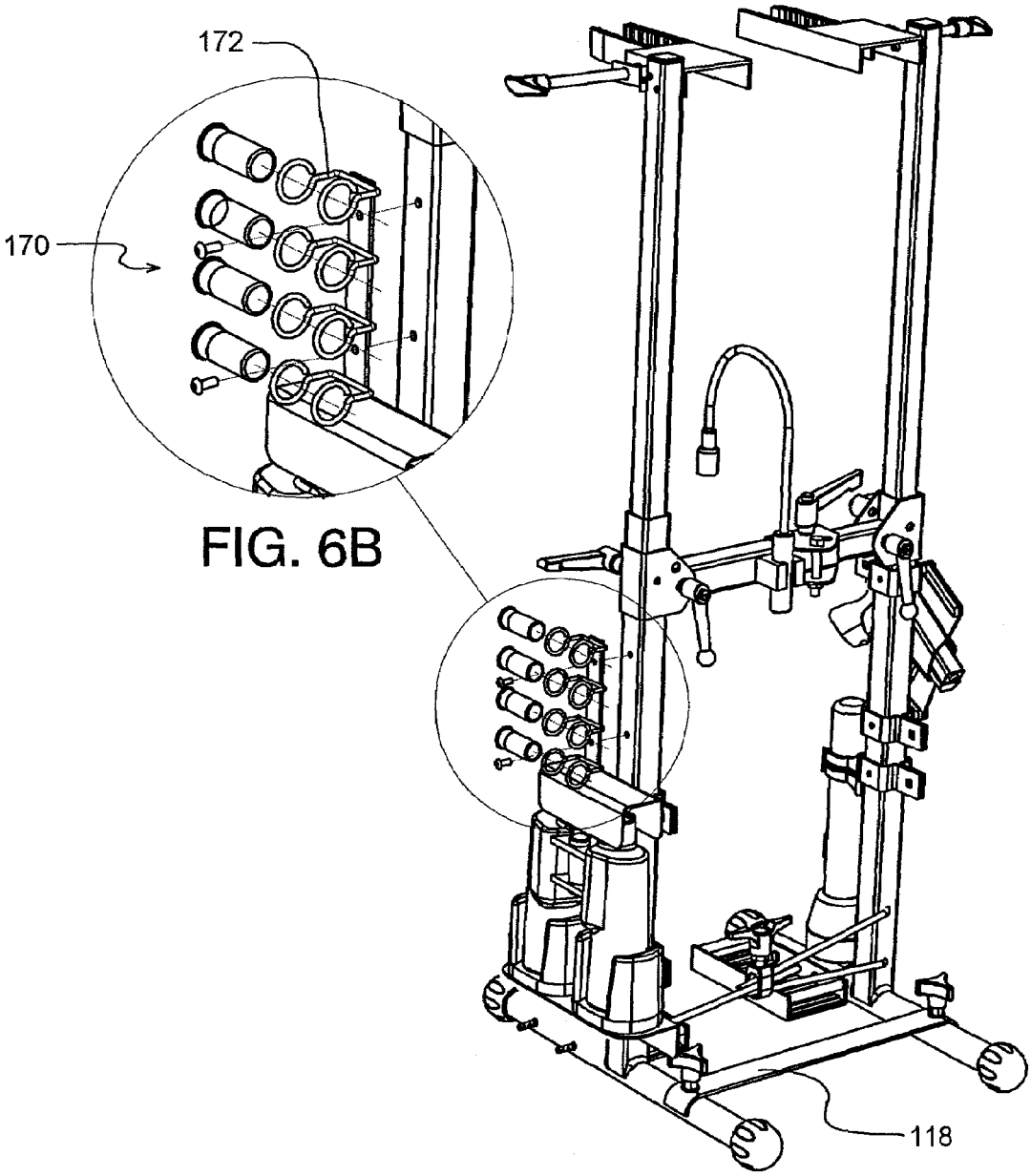
FIG. 6A illustrates an exploded view of the preferred embodiment of the ammunition holder assembly 170.
FIG. 6B illustrates an enlarged exploded view of the preferred embodiment of the ammunition holder assembly 170.

As shown in FIGS. 6A & 6B, the optional ammunition holder assembly 170 comprises an ammunition holder 172 and at least one connection to the convertible frame 110. While a variety of ammunition holders may work, a preferred example is an ammunition holder sold by Tacstar under the trademark Sidesaddle. The at least one connection to the convertible frame 110 can be a fixed through-bolt type connection or a friction-type connection. It is preferred to connect the ammunition holder 172 to a vertical member 113 using two screws as shown in FIG. 6B.

Figure 7:
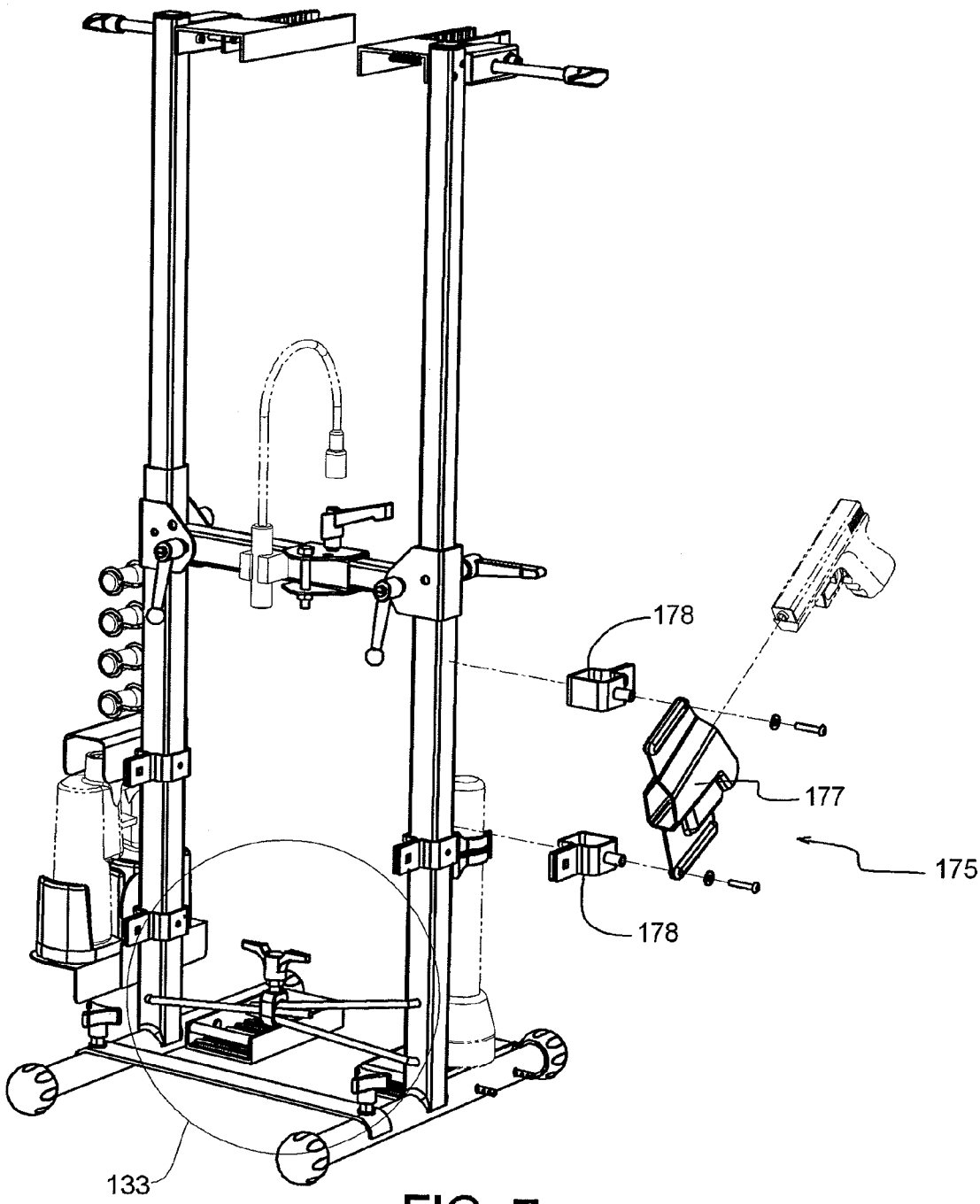
FIG. 7 illustrates an exploded view of the preferred embodiment of the pistol holder assembly 175.

As shown in FIG. 7, the optional pistol holder assembly 175 comprises a pistol holder 177 and at least one connection to the convertible frame 110. While a variety of pistol holders 177 may work, a preferred example is a pistol holder sold by Glock under the trademark Glock®. The at least one connection to the convertible frame 110 can be a fixed through-bolt type connection or a friction-type connection. It is preferred to connect the pistol holder 177 to a vertical member 113 using at least two brackets 178 as shown in FIG. 7.

As shown in FIG. 8, the optional binocular holder assembly 180 comprises a top retaining member 182 and a bottom-retaining member 184. The top-retaining member 182 can be a fabricated metal channel as shown in FIG. 8. The top-retaining member 182 can be secured to a vertical member 113 by a fastening means, but it is preferred to use a bracket and through-bolt connection or a friction-type connection. The bottom-retaining member can comprise holding base 186 and a shelf 188. While a variety of holding bases may work, it is preferred that the holding base 186 be an adjustable cup holder manufactured by Spillmaster under the name Euro Jr. and pursuant to U.S. Pat. No. 5,149,032. The holding base 186 rests on the shelf 188 and is secured to the shelf by suitable fastening means. The shelf can be fabricated from sheet metal and formed in the shape as shown in FIG. 8. The retaining base 184 can connect to a vertical member 113 by a fastening means, but it is preferred to use a bracket and through-bolt connection or a friction-type connection.

Figure 9:
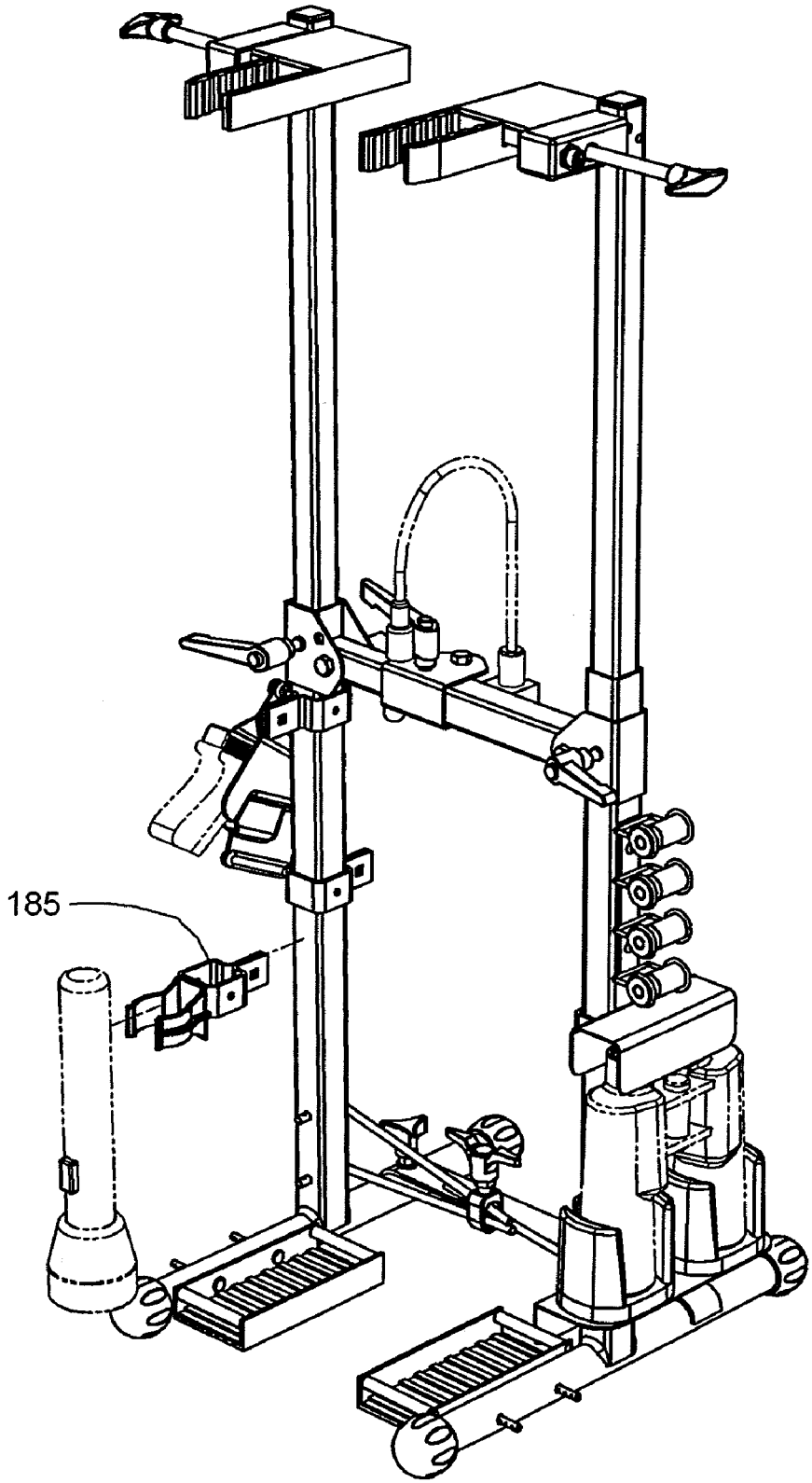
FIG. 9 illustrates an exploded view of the preferred embodiment of the flashlight holder assembly.
Figure 10:
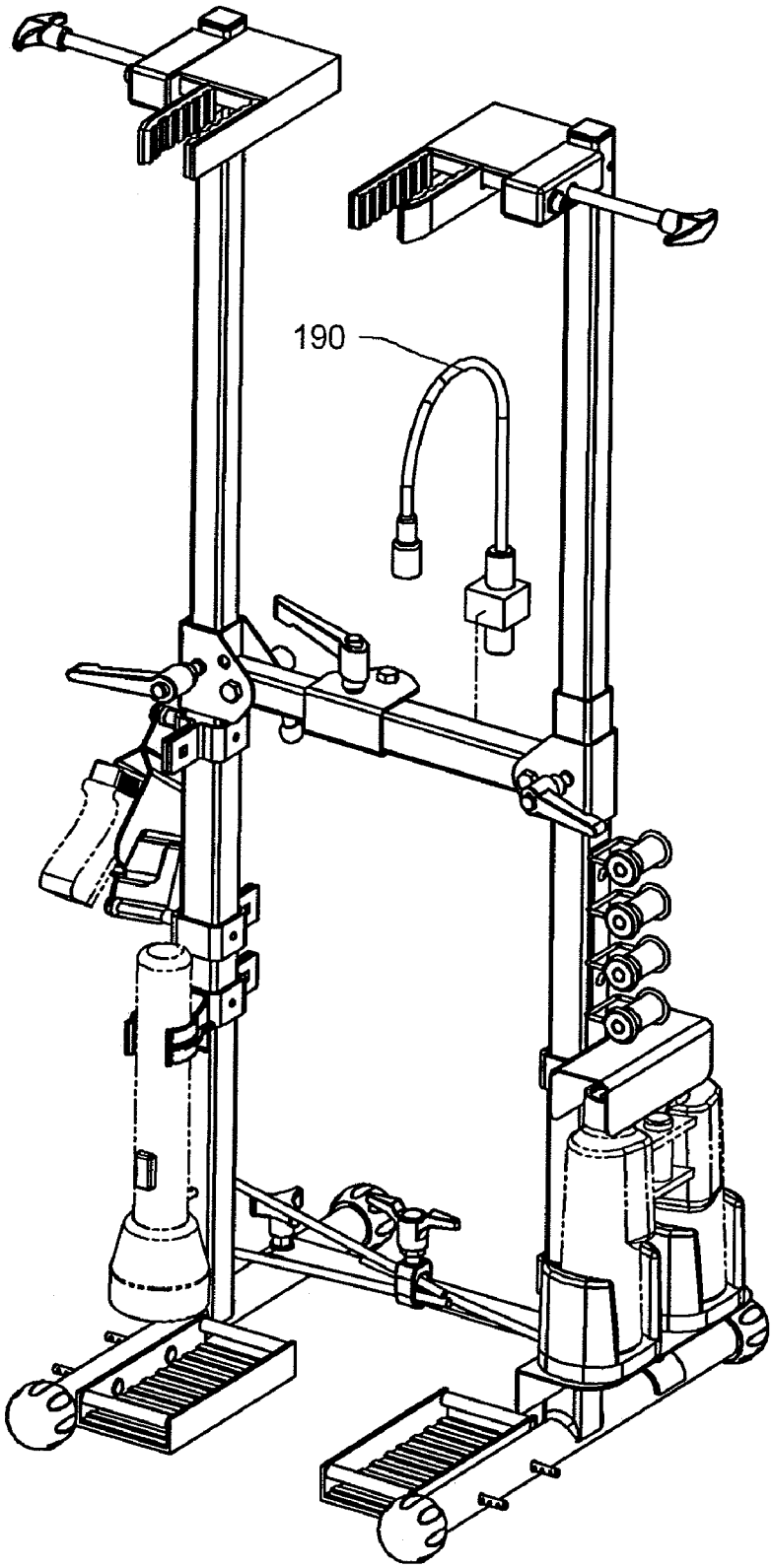
FIG. 10 illustrates a preferred embodiment of the infrared light assembly.

The optional flashlight holder assembly 185 comprises a flashlight holder and at least one connection to the convertible frame 110. While a variety of flashlight holders may work, a preferred example is a flashlight holder sold by Total Escape, model number ASXDO126 (mounting bracket). The at least one connection to the convertible frame 110 can be a fixed through-bolt type connection or a friction-type connection. It is preferred to connect the flashlight holder to a vertical member 113 by a bracket as shown in FIG. 9.

The optional infrared light attachment 190 comprises an infrared light, a flexible conduit, and at least one connection to the convertible frame 110. While a variety of infrared light attachments may work, a preferred example is a battery-operated infrared light sold by Armstrong Medical Industries, Inc. under the name Flex Light, product number AFL-1. The optional infrared light can be secured to the mobile system by and suitable fastening means, but it is preferred to connecting to the mobiles storage system by using the magnet connection that is sole with light sold by Armstrong Medical Industries, Inc. under the name Flex Light, product number AFL-1.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A method of converting a single long-barreled gun storage system to a dual long-barreled gun storage system, providing a single long-barreled gun storage system comprising a quick-release clamp, a frame comprising a left frame and a right frame, the left frame further comprising a base member and a vertical member, the right frame further comprising a base member and a vertical member, a first weapon shelf connected to the base member of the left frame, and a second weapon shelf connected to the base member of the right frame, wherein the quick-release clamp is connected to the vertical member of the left frame, wherein a first distal end of a convertible horizontal member is pivotably connected to the vertical member of the right frame, and wherein the vertical member of the right frame is rotated about an axis running through the base member of the right frame so that the vertical member of the right frame can be releasably connected to the vertical member of the left frame, comprising the following steps: releasing the connection between the vertical member of the right frame and the vertical member of the left frame, rotating the vertical member of the right frame about the axis to create a gap between the respective vertical members, connecting a second distal end of the convertible horizontal member to the vertical member of the left frame, connecting a second quick-release clamp to the vertical member of the right frame above the second weapons shelf and placing at least one long-barreled gun in the system in either one of the left or right frames whereby the butt of the gun rests on a respective weapons shelf and the barrel of the gun is disposed within the respective quick release clamp.

* * * * *